US009897381B2

(12) United States Patent
Liu et al.

(10) Patent No.: US 9,897,381 B2
(45) Date of Patent: Feb. 20, 2018

(54) SUPPORTING STRUCTURE AND OVEN

(71) Applicant: Wuhan China Star Optoelectronics Technology Co., Ltd., Wuhan, Hubei (CN)

(72) Inventors: Kaixin Liu, Guangdong (CN); Daosong Lu, Guangdong (CN); Xiaolong Ye, Guangdong (CN); Gongyu He, Guangdong (CN)

(73) Assignee: Wuhan China Star Optoelectronics Technology Co., Ltd., Wuhan, Hubei (CN)

( * ) Notice: Subject to any disclaimer, the term of this patent is extended or adjusted under 35 U.S.C. 154(b) by 73 days.

(21) Appl. No.: 15/219,576

(22) Filed: Jul. 26, 2016

(65) Prior Publication Data

US 2017/0276431 A1 Sep. 28, 2017

(30) Foreign Application Priority Data

Mar. 25, 2016 (CN) ..... 2016 2 0240524 U

(51) Int. Cl.
*F27D 5/00* (2006.01)

(52) U.S. Cl.
CPC ..... *F27D 5/00* (2013.01)

(58) Field of Classification Search
CPC ..... H01L 2224/32245; H01L 21/6734; H01L 21/6875; G02F 1/133608; G02F 2001/133322; G02F 1/133308; F27D 5/00; G09F 13/0413
See application file for complete search history.

(56) References Cited

U.S. PATENT DOCUMENTS 7,618,256 B2 * 11/2009 Park ..... G02F 1/1339 211/126.15
9,187,243 B2 * 11/2015 Hashimoto ..... B65G 49/061
9,221,603 B2 * 12/2015 Hashimoto ..... H01L 21/67326
9,605,797 B2 * 3/2017 Han ..... F16M 13/00
9,656,797 B2 * 5/2017 Hong ..... B65D 85/48
(Continued)

FOREIGN PATENT DOCUMENTS

CN 1614469 A 5/2005
CN 101506573 A 8/2009
(Continued)

*Primary Examiner* — Gregory A Wilson
(74) *Attorney, Agent, or Firm* — Andrew C. Cheng

(57) ABSTRACT

A supporting structure for supporting a substrate in an oven is disclosed. The oven is for baking the substrate in a production process of liquid crystal panel. The supporting structure includes: a fixing frame including a frame body, and a fixing portion and a support portion fixed to the frame body, wherein the fixing portion provides with a sliding slot, the fixing portion is provided with at least one positioning region located inside the sliding slot, through a fastener passing through the positioning region, the fixing portion is secured and fixed to a heating platform of the oven such that the frame body is fixed to the heating platform; a supporting strip engaged at the support portion; and multiple supporting pins disposed separately on the supporting strip to support the substrate. The supporting structure can move positions of the supporting pins. An oven applying the supporting structure is also disclosed.

10 Claims, 2 Drawing Sheets

(56) References Cited

U.S. PATENT DOCUMENTS

| | | | | |
|---|---|---|---|---|
| 9,691,647 | B2 * | 6/2017 | Wang | H01L 21/6734 |
| 2011/0109843 | A1 | 5/2011 | Jung | |
| 2015/0023055 | A1 | 1/2015 | Hwang et al. | |
| 2017/0082366 | A1 * | 3/2017 | Chivers | F27D 11/02 |

FOREIGN PATENT DOCUMENTS

| | | | |
|---|---|---|---|
| CN | 102767740 | A | 11/2012 |
| CN | 103827572 | A | 5/2014 |
| CN | 203686775 | U | 7/2014 |
| CN | 104238186 | A | 12/2014 |
| JP | 2014164833 | A | 9/2014 |
| KR | 20130135483 | A | 12/2013 |

* cited by examiner

SUPPORTING STRUCTURE AND OVEN

FIELD OF THE INVENTION

The present invention relates to an equipment technology field of panel display industry, and more particularly to a supporting structure and an oven applying the supporting structure.

DESCRIPTION OF RELATED ART

In a PI (Polyimide) process stage of manufacturing a liquid crystal panel, a substrate printed with a PI liquid is required transferring a heating platform having a temperature around 100° C. for performing a prebaking process such that a solvent in the PI liquid is evenly volatilized and form a film. In the heating process, using supporting pins having a certain height to support the substrate such that a certain distance is maintained between the substrate and the heating platform in order to ensure the heating uniformity of the PI liquid on the surface of the substrate. Because between the position of the surface of the substrate contacted with the supporting pins and other positions, temperature difference is existed, an uneven heating to the surface of the PI film when baking is easily generated such that a mura phenomenon (mura means that a phenomenon of various marks because of uneven brightness) is generated at a liquid crystal panel applying the substrate. In the manufacturing process, moving the positions of the supporting pins to an ineffective region (that is, a non-display region) such that the mura phenomenon is located within the ineffective region.

However, in the conventional manufacturing process, the supporting pins are installed on fixed locations of the heating platform for supporting the substrate. The fixed locations can only correspond to one type of substrate such that the positions of the supporting pins are located within the ineffective region of the substrate. When the heating platform is used for heating other types of substrates, because the positions of the supporting pins are fixed, the supporting pins are easily located in an effective region of the substrate such that the liquid crystal panel applying the substrate generates the mura phenomenon.

SUMMARY OF THE INVENTION

The technology problem solved by the present invention is to provide a supporting structure that can move the positions of the supporting pins, and the supporting structure is used for supporting a substrate in an oven.

In order to achieve the above purpose, the embodiment of the present invention adopts the following technology solutions:

On the one hand, providing a supporting structure for supporting a substrate in an oven, the oven is used for baking the substrate in a production process of a liquid crystal panel, and the supporting structure comprises:

a fixing frame including a frame body, and a fixing portion and a support portion which are fixed to the frame body, wherein the fixing portion is provided with a sliding slot, the fixing portion is provided with at least one positioning region located inside the sliding slot, through a fastener passing through the positioning region, the fixing portion is secured and fixed to a heating platform of the oven such that the frame body is fixed to the heating platform;

a supporting strip engaged at the support portion; and multiple supporting pins disposed separately on the supporting strip to support the substrate.

Wherein, the sliding slot is a strip-shaped slot, and the fixing portion is provided with at least two positioning regions inside the sliding slot.

Wherein, the sliding slot is a cross-shaped slot or a rectangular slot, and the fixing portion is provided with at least four positioning regions located inside the sliding slot.

Wherein, the sliding slot is V-shaped or Δ-shaped, and the fixing portion is provided with at least three positioning regions located inside the sliding slot.

Wherein, the fastener is a bolt, a stud or a screw.

Wherein, the support portion includes a support slot, and the supporting strip is engaged in the support slot.

Wherein, each supporting pin adopts a ceramic material.

Wherein, the frame body and the fixing portion form an included angle for gripping and holding the frame body conveniently.

On the other hand, also providing an oven used for baking a substrate of a liquid crystal panel, comprising: a heating platform; and a supporting structure as described in any one of the above.

Wherein the number of the fixing frames of the supporting structure is two, the fixing frames are disposed oppositely at two sides of the heating platform, each of the fixing frames includes at least two support portions, the support portions of the two fixing frames are disposed correspondingly one by one, and two terminals of the supporting strip are respectively engaged at two of the corresponding support portions of the fixing frame.

Comparing to the prior art, the present invention has following advantageous effects:

In the supporting structure of the present embodiment, the fixing portion is provided with at least one positioning region located inside the sliding slot. The fastener passes through the positioning region in order to fix the fixing portion to the heating platform of the oven. Therefore, when the fastener passes through different positioning regions, the fixing portion generates a displacement with respect to the heating platform so as to move positions of the supporting pins to generate a displacement with respect to the heating platform. Because the positions of the supporting pins of the supporting structure can be moved so that the positions of the supporting pins can fall in a non-display region of the substrate such that a liquid crystal panel applying the substrate can avoid generating a mura phenomenon.

BRIEF DESCRIPTION OF THE DRAWINGS

In order to more clearly illustrate the technical solution in the present invention or in the prior art, the following will illustrate the figures used for describing the embodiments or the prior art. It is obvious that the following figures are only some embodiments of the present invention. For the person of ordinary skill in the art without creative effort, it can also obtain other figures according to these figures.

DETAILED DESCRIPTION OF THE PREFERRED EMBODIMENT

The following content combines with the drawings and the embodiment for describing the present invention in detail. It is obvious that the following embodiments are only some embodiments of the present invention. For the person of ordinary skill in the art without creative effort, the other embodiments obtained thereby are still covered by the present invention Besides, the description of the following embodiments is referred to the appended figures in order to exemplarily illustrate the specific embodiments of the present invention. The directional terms mentioned in the present invention such as "up", "down", "front", "rear", "left", "right", "inside", "outside", "side surface" and so on only refer to the direction of appended figures. Therefore, the adopted directional terms are for describing and understanding the present invention better and more clearly, not for indicating or implying the device or component having specific direction or operating by using a specific directional structure. Therefore, cannot be understood as the limitation of the present invention.

In the description of the present invention, it should be noted that unless additional definite rule and limitation are provided, the term "install", "link", "connect" should be understood broadly. For example, can be fixedly connected or detachably connected or integrally connected; or mechanically connected, directly connected, indirectly connected through an intermediate or internal communication between two components. For the person of ordinary skill in the art, the specific meaning of the present invention of the above terms can be understood based on specific situation.

Figure 1:
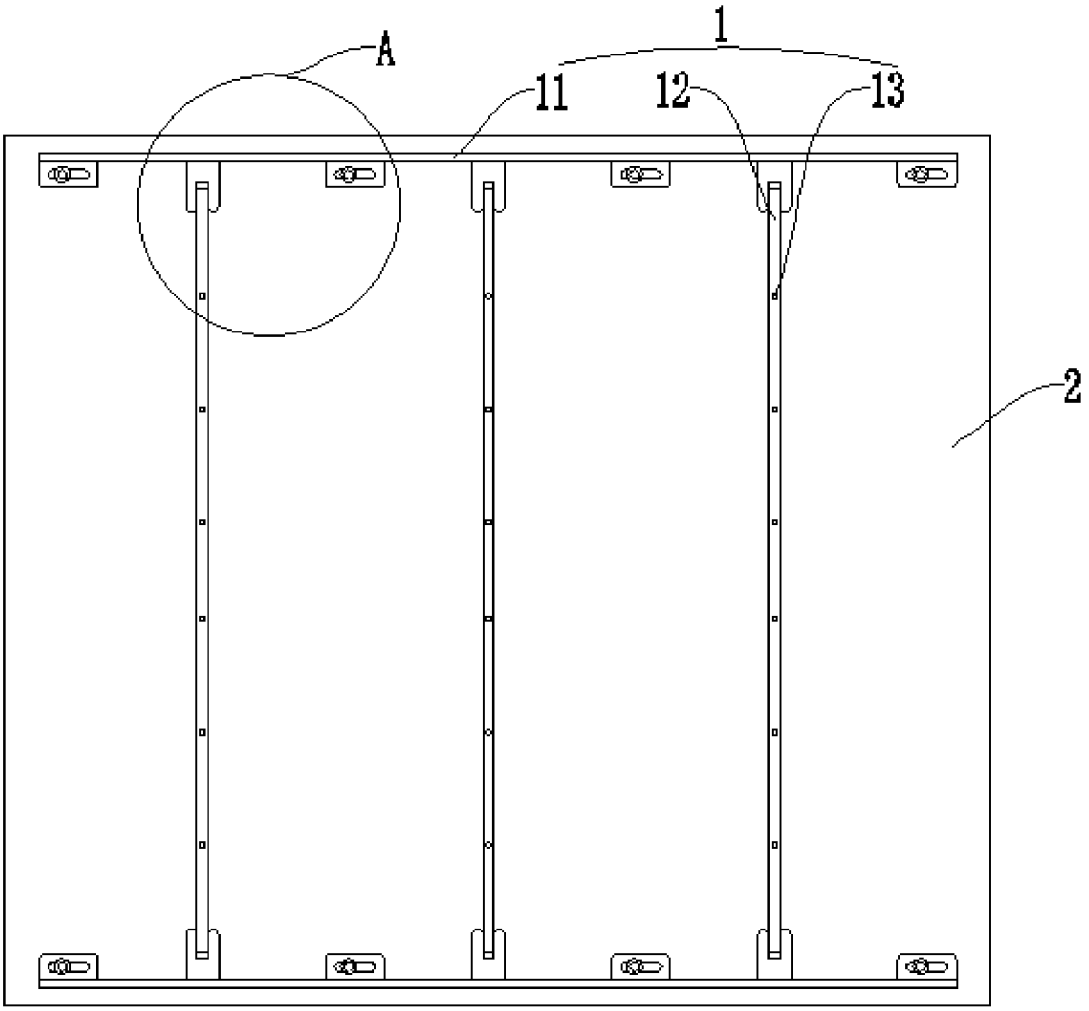
FIG. 1 is a schematic structure diagram of an oven provided by an embodiment of the present invention.
Figure 2:
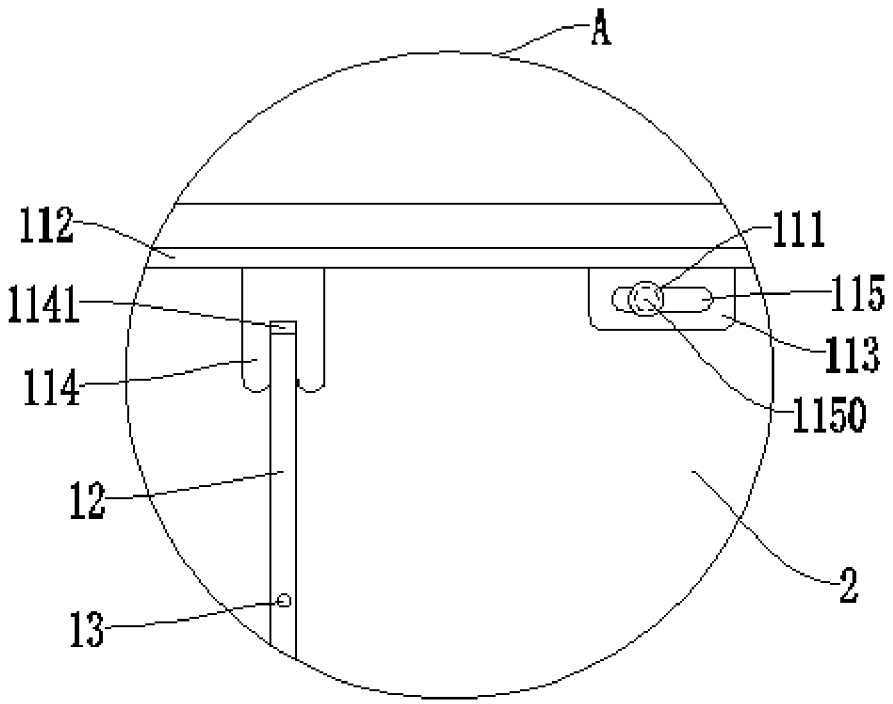
FIG. 2 is an enlarged schematic diagram of the structure at portion A in FIG. 1.

With reference to FIG. 1 and FIG. 2, the present embodiment provides a supporting structure 1 for supporting a substrate in an oven. The oven is used for baking the substrate in a production process of liquid crystal panel. The supporting structure 1 includes a fixing frame 11, a supporting strip 12 and multiple supporting pins 13. The fixing frame 11 includes a fastener 111, a frame body 112, a fixing portion 113 fixed to the frame body 112 and a support portion 114 fixed to the frame body 112. The fixing portion 113 is provided with a sliding slot 115. The fixing portion 113 is provided with at least one positioning region 1150 located inside the sliding slot 115. Through the fastener 111 passing through the positioning region 1150, the fixing portion 113 is secured and fixed to a heating platform 2 of the oven such that the frame body 112 is fixed to the heating platform 2. The supporting strip 12 is engaged at the support portion 114. The multiple supporting pins 13 are disposed separately on the supporting strip 12 to support the substrate.

In the present embodiment, because the fixing portion 113 is provided with at least one positioning region 1150 located inside the sliding slot 115, the fastener 111 passing through the positioning region 1150 in order to secure and fix the fixing portion 113 to the heating platform 2 of the oven, therefore, when the fastener 111 passes through different positioning regions 1150 (that is, located at different positions of the sliding slot 115), the fixing portion 113 generates a displacement with respect to the heating platform 2 so as to move positions of the supporting pins 13 to generate a displacement with respect to the heating platform 2. Because the positions of the supporting pins 13 of the supporting structure 1 can be moved so that the positions of the supporting pins 13 can fall in a non-display region of the substrate such that a liquid crystal panel applying the substrate can avoid generating a mura phenomenon.

Furthermore, with reference to FIG. 1 and FIG. 2, as an alternative embodiment, the sliding slot 115 of the fixing portion 113 is a strip-shaped slot. The fixing portion 113 is provided with at least two positioning regions inside the sliding slot 115. At the same time, because the sliding slot 115 is a continuous strip-shaped slot, anyone position inside the sliding slot 115 can be the positioning region. A user can flexibility adjust the position that the fastener 111 passes through the sliding slot 115 in order to adjust the positions of the supporting pins 13 to satisfy a supporting requirement of different products.

In the present embodiment, the direction of the strip-shaped slot of the sliding slot 115 can be any direction. As the embodiment shown in FIG. 2, the strip-shaped slot of the sliding slot 115 is disposed horizontally. Particularly, when the sliding slot 115 are disposed obliquely (that is, forming an included angle with respect to a horizontal direction and a vertical direction), the fixing portion 113 can realize adjusting a horizontal and vertical displacement with respect to the heating platform 2 such that the application of the supporting structure 1 can be more flexible and diverse to be suitable for the supporting of more types of substrates.

Furthermore, as an alternative embodiment, the sliding slot 115 of the fixing portion 113 is a cross-shaped slot or a rectangular slot. The fixing portion 113 is provided with at least four positioning regions located inside the sliding slot 115. For example, the four positioning regions can be arranged at four endpoints of the sliding slot 115. At the same time, because the sliding slot 115 is continuous, any one position inside the sliding slot 115 can be the positioning region. The fixing portion 113 can realize adjusting a horizontal and vertical displacement with respect to the heating platform 2 such that the application of the supporting structure 1 can be more flexible and diverse to be suitable for the supporting of more types of substrates.

Furthermore, as an alternative embodiment, the sliding slot 115 of the fixing portion 113 can be V-shaped or Δ-shaped. The fixing portion 113 is provided with at least three positioning regions located inside the sliding slot 115. For example, the three positioning regions can be arranged at three endpoints of the sliding slot 115. At the same time, because the sliding slot 115 is continuous, any one position inside the sliding slot 115 can be the positioning region. The fixing portion 113 can realize adjusting a horizontal and vertical displacement with respect to the heating platform 2 such that the application of the supporting structure 1 can be more flexible and diverse to be suitable for the supporting of more types of substrates.

It can be understood that the sliding slot 115 can also be other different shapes such as an annular shape, a pentagonal shape and so on, no more repeating here.

Furthermore, optionally, the fastener 111 is a mechanical part used for fastening and connecting so that the fastener 111 can be a bolt, a stud or a screw.

Furthermore, with reference to FIG. 1 and FIG. 2, the support portion 114 includes a support slot 1141, and the supporting strip 12 is engaged in the support slot 1141. As shown in FIG. 2, when a space inside the support slot 1141 is larger than a size of the supporting strip 12 engaged inside the support slot 1141, the supporting strip 12 can slightly move with respect to the supporting strip 12. Therefore, through adjusting the position of the supporting strip 12, slightly adjusting the positions pf the supporting pins 13 can be realized.

Furthermore, the supporting strip 12 adopts a wearable and high temperature resistant material. The supporting pin 13 adopts a wearable, high temperature resistant and anti-static material such as ceramics.

Figure 3:
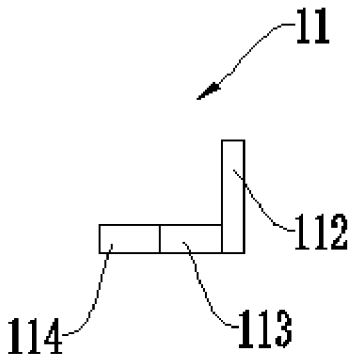
FIG. 3 is a schematic structure diagram of a fixing frame of a supporting structure of an oven provided by an embodiment of the present invention.

Furthermore, with reference to FIG. 1 to FIG. 3, optionally, the frame body 112 of the fixing frame 11 and the fixing portion 113 form an included angle for griping and holding the frame body 112 conveniently. Particularly, when the fixing frame 11 is heated to be hot by the high temperature of the heating platform 2, a user can grip and hold the frame body 112 in order to move the fixing frame 11.

Optionally, the number of the fixing portion 113 and the support portion 114 of the fixing structure 1 can be flexibility adjusted. Generally, the number is at least two. For example, in the embodiment as shown in FIG. 1, the number of the fixing portions 113 is four, adjacent fixing portions 113 are disposed at an interval. The number of the support portions 114 is three, and the support portions 114 are respectively disposed at locations between two adjacent fixing portions 113.

With reference to FIG. 1, the embodiment of the present invention also provides an oven, and the oven includes a heating platform 2 and a supporting structure 1 as described above. The oven can be used for baking a substrate of a liquid crystal panel. Because the oven adopts the supporting structure 1, positions of the supporting pins 13 can be moved. Therefore, the supporting pins 13 can fall in a non-display region of the substrate such that a liquid crystal panel applying the substrate can avoid generating a mura phenomenon.

Furthermore, with reference to FIG. 1 and FIG. 2, specifically, the number of the fixing frames 11 of the supporting structure 1 is two. Besides, the fixing frames 11 are disposed oppositely at two sides of the heating platform 2. Each of the fixing frames 11 includes at least two support portions 114, and the support portions 114 of the two fixing frames 11 are disposed correspondingly one by one. Two terminals of the supporting strip 12 are respectively engaged at two of corresponding support portions 114 of the fixing frame 11.

In the present embodiment, the number of the supporting strips 12 is less than or equal to the number of the support portions 114 at each fixing frame 11. The supporting strip 12 can be engaged at different support portions 114 according to different product such that the positions of the supporting pins 13 are different.

The above embodiment is described in detail. The specification adopts specific example to illustrate the principle and embodiment of the present invention. The illustration of the above embodiments is only used for helping understanding the method and core idea of the present invention; at the same time, for one person ordinary skilled in the art, based on the idea of the present invention, the specific embodiments and application range will be changed. In summary, the content of the specification should not be understood as a limitation of the present invention.

What is claimed is:

1. A supporting structure for supporting a substrate in an oven, the oven is used for baking the substrate in a production process of a liquid crystal panel, and the supporting structure comprises:

a fixing frame including a frame body, and a fixing portion and a support portion which are fixed to the frame body, wherein the fixing portion is provided with a sliding slot, the fixing portion is provided with at least one positioning region located inside the sliding slot, through a fastener passing through the positioning region, the fixing portion is secured and fixed to a heating platform of the oven such that the frame body is fixed to the heating platform;

a supporting strip engaged at the support portion; and multiple supporting pins disposed separately on the supporting strip to support the substrate.

2. The supporting structure according to claim 1, wherein, the sliding slot is a strip-shaped slot, and the fixing portion is provided with at least two positioning regions inside the sliding slot.

3. The supporting structure according to claim 1, wherein, the sliding slot is a cross-shaped slot or a rectangular slot, and the fixing portion is provided with at least four positioning regions located inside the sliding slot.

4. The supporting structure according to claim 1, wherein, the sliding slot is V-shaped or Δ-shaped, and the fixing portion is provided with at least three positioning regions located inside the sliding slot.

5. The supporting structure according to claim 1, wherein, the fastener is a bolt, a stud or a screw.

6. The supporting structure according to claim 1, wherein, the support portion includes a support slot, and the supporting strip is engaged in the support slot.

7. The supporting structure according to claim 1, wherein, each supporting pin adopts a ceramic material.

8. The supporting structure according to claim 1, wherein, the frame body and the fixing portion form an included angle for gripping and holding the frame body conveniently.

9. An oven used for baking a substrate of a liquid crystal panel, comprising:

a heating platform; and a supporting structure as claimed in claim 1.

10. The oven according to claim 9, wherein the number of the fixing frames of the supporting structure is two, the fixing frames are disposed oppositely at two sides of the heating platform, each of the fixing frames includes at least two support portions, the support portions of the two fixing frames are disposed correspondingly one by one, and two terminals of the supporting strip are respectively engaged at two of corresponding support portions of the fixing frame.

* * * * *